United States Patent [19]

Mizota et al.

[11] Patent Number: 4,706,735

[45] Date of Patent: Nov. 17, 1987

[54] CONTINUOUS CASTER INCLUDING AN ELECTROMAGNETIC STIRRING APPARATUS

[75] Inventors: Hisakazu Mizota; Shinji Kojima, both of Okayama, Japan

[73] Assignee: Kawasaki Steel Corporation, Kobe, Japan

[21] Appl. No.: 14,097

[22] PCT Filed: Dec. 7, 1983

[86] PCT No.: PCT/JP83/00433

§ 371 Date: Apr. 11, 1984

§ 102(e) Date: Apr. 11, 1984

[87] PCT Pub. No.: WO85/02569

PCT Pub. Date: Jun. 20, 1985

Related U.S. Application Data

[63] Continuation of Ser. No. 606,776, Apr. 11, 1984, abandoned.

[30] Foreign Application Priority Data

Jun. 8, 1982 [JP] Japan ..... 57-97972

[51] Int. Cl.[4] ..... B22D 11/10; B22D 11/124

[52] U.S. Cl. ..... 164/504; 164/441; 164/443; 164/444

[58] Field of Search ..... 164/468, 504, 443, 444, 164/441, 447

[56] References Cited

U.S. PATENT DOCUMENTS

| | | | |
|---|---|---|---|
| 3,399,716 | 9/1968 | Rossi | 164/486 |
| 4,009,749 | 3/1977 | Alberny | 164/504 |
| 4,026,346 | 5/1977 | Birat et al. | 164/504 |
| 4,103,730 | 8/1978 | Dussart | 164/504 X |
| 4,164,974 | 8/1979 | Ruer et al. | 164/504 |
| 4,444,245 | 4/1984 | Hippert | 164/504 |

FOREIGN PATENT DOCUMENTS

| | | | |
|---|---|---|---|
| 0010314 | 4/1980 | European Pat. Off. . | |
| 0011861 | 6/1980 | European Pat. Off. . | |
| 57-19140 | 2/1982 | Japan | 164/504 |
| 57-94458 | 6/1982 | Japan | 164/504 |
| 2109724A | 6/1983 | United Kingdom | 164/504 |
| 229759 | 2/1969 | U.S.S.R. | 164/504 |

*Primary Examiner*—Nicholas P. Godici
*Assistant Examiner*—J. Reed Batten, Jr.
*Attorney, Agent, or Firm*—Balogh, Osann, Kramer, Dvorak, Genova & Traub

[57] ABSTRACT

An electromagnetic stirring apparatus arranged at an arbitrary position from just beneath a mold to a secondary cooling zone in a continuous caster, so as to close about a cast strand containing an unsolidified molten metal therein. The apparatus is fundmentally constituted such that guide plates each having a cooling function are detachably attached at their back face to corresponding cores each constituting an electromagnetic coil so that the coil can approach as near as possible to the cast strand.

8 Claims, 9 Drawing Figures

CONTINUOUS CASTER INCLUDING AN ELECTROMAGNETIC STIRRING APPARATUS

This application is a continuation of application Ser. No. 606,776, filed Apr. 11, 1984 and now abandoned.

TECHNICAL FIELD

This invention relates to an electromagnetic stirring apparatus arranged just beneath a mold in a secondary cooling zone of a continuous caster and combined with guide means, and more particularly an electromagnetic stirring apparatus used for stirring unsolidified molten metal, which is contained in a cast strand drawn from the mold, while guiding and cooling the cast strand so that the solidification structure may be improved to enhance the quality of the cast slab or bloom.

BACKGROUND TECHNIQUE

Recently, there has been widely used, a technique for stirring molten metal such as molten steel by use of an electromagnetic force in order to improve the quality of the cast slab or bloom, particularly, the solidification structure thereof in the field of the continuous casting of steel or the like. Although the purpose of such use of electromagnetic stirring is different depending upon the place of installation, when the electromagnetic stirring is applied (for example, to a mold for continuous casting), it lies mainly in flowing molten steel to promote floating of bubbles and inclusions and hence removal of bubble defects such as pinholes and blow holes and non-metallic inclusions. Further, the electromagnetic stirrer arranged at the secondary cooling zone beneath the mold is aimed mainly at the increase of equiaxed crystal zone ratio.

Since the idea per se that the electromagnetic stirrer is attached to the continuous caster is a technique quite recently adopted, a concrete structure of the stirrer has not yet been developed. Therefore, a concrete example of the stirrer arranged together with the guide means beneath the mold which is the subject of the invention, is not clearly found in the prior art, but the arrangements of the stirrer just beneath the mold as shown in FIGS. 1 and 2 which show an electromagnetic stirring apparatus, a mold, and a cast strand supporting just beneath the mold.

Such a guide means arranged just beneath the mold is necessary for preventing the cast strand having a thin solidification shell just beneath the outlet of the mold from being broken or deformed due to the unsolidified molten steel remaining in the interior thereof, and also preventing the friction against the lower end portion of the inner wall of the mold. In general, foot rollers (FIG. 1) are arranged in rows or guide plates (FIG. 2) are adopted. Also, support rolls 5 are arranged in rows (FIGS. 1 and 2) for supporting the cast strand.

FIG. 1 is an embodiment of the guide means designed as foot rollers 3 for supporting the cast strand just beneath the mold 2, behind (on the outer side) which is arranged a ring-shaped coil 4 of a rotating magnetic field system. In this embodiment, the coil 4 is so remote from the cast strand that the magnetic force is largely reduced to drop the stirring force, an induced current is produced in the foot rolls 3 to cause troubles such as electrolytic corrosion and the like, and further it is structurally difficult to conduct spray cooling on a steel strand 1.

FIG. 2 is an embodiment of the guide means in which guide plates 6 for the protection of the coil, which also serve to guide the cast strand, are arranged in front of the coil 4 of the rotating magnetic field system. Although this embodiment has the advantage that it is possible to put the coil 4 close to the cast strand 1, the guide plates 6 can not cool the cast strand 1, so that there is a risk of causing abnormal bulging of the cast strand 1 due to the lack of sufficient cooling. Moreover, if the guide plate 6 is made into a water-cooled structure capable of cooling the cast strand, the thickness thereof would need to be greater, hence losing the advantage achieved by closeness of the coil to the cast strand.

It is, therefore, an object of the invention to provide an electromagnetic stirring apparatus with a compact structure which is free from the problems encountered by the conventional electromagnetic stirrer arranged beneath the mold, and gives effectively a stirring force required for the improvement of the quality together with a guiding function inherent to the water-cooled guide plate.

Further, it is another object of the invention to provide an electromagnetic stirring apparatus with a compact structure which is free from the problems encountered by the conventional electromagnetic stirrer arranged beneath the mold, performs a satisfactory cooling while developing an inherent guiding function, and effectively gives a stirring force required for the improvement of the quality.

SUMMARY OF THE INVENTION

In order to realize the above objects, the invention proposes an electromagnetic stirring apparatus for use in a continuous caster, comprising a plurality of guide plates each arranged adjacent to a respective side of a cast strand so as to close about or surround the cast strand containing an unsolidified molten metal therein beneath a mold and provided with a flow path for a cooling liquid, and a plurality of electromagnetic coils each containing an iron core therein, the iron core being detachably attached at its front face to the respective guide plate; and an electromagnetic stirring apparatus for use in a continuous caster, comprising a plurality of guide plates each of which are arranged adjacent to a respective one of the sides of a cast strand so as to close about or surround the cast strand containing unsolidified molten metal therein beneath a mold and provided with a plurality of spray holes opening to the cast strand, and a plurality of electromagnetic coils each containing an iron core therein, the iron core being detachably attached at its front face to the respective guide plate, and integrally supported by a common member of a ring-like shape.

The invention of the above mentioned construction provides a compact apparatus with a so-called combined structure of electromagnetic stirrer and guide means which can perform the cooling enough to prevent break-out and bulging and the stirring efficient to obtain a solidification structure with a high equiaxed crystal zone ratio.

BEST MODE FOR CARRYING OUT THE INVENTION

The invention will be described in detail with reference to the accompanying drawings. The invention is characterized by having a compact structure obtained by combining guide plates as the conventional guide means with an electromagnetic coil.

Figure 4:
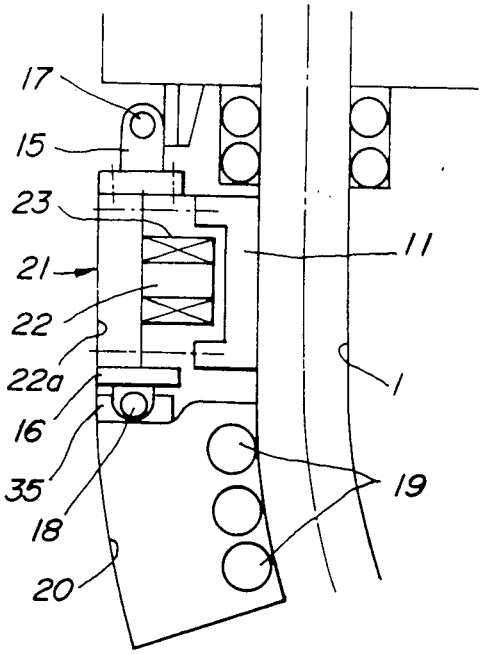
FIG. 4 is a schematic view illustrating another embodiment of the apparatus according to the invention.
Figure 5:
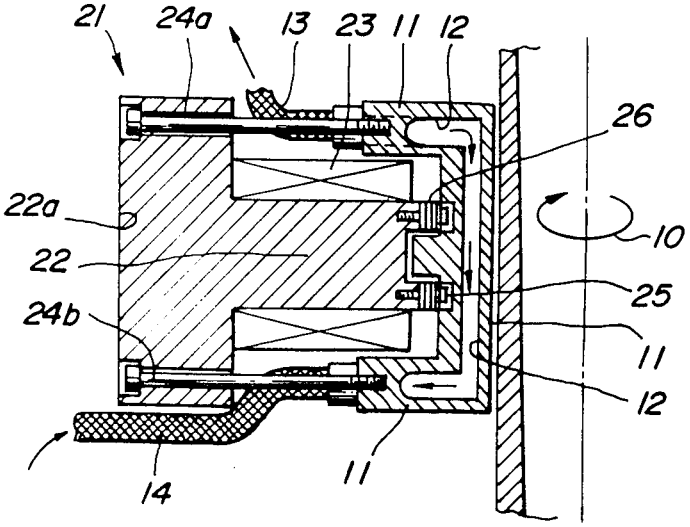
FIG. 5 is an enlarged sectional view of the embodiment shown in FIG. 4.

A guide plate shown by numeral 11 is to cool a cast strand 1 and is provided at its inside with a flow path 12 for a cooling liquid as shown in FIGS. 4 and 5. In general, cooling water is introduced from a lower supply tube 14 and drawn out from an upper discharge tube 13, whereby the guide plate 11 is cooled per se and at the same time the cast strand 1 is cooled to promote the solidification thereof. The guide plate 11 is attached to an iron core 22, while the upper side of the core 22 is engaged with the lower end of the mold to be movable in up and down direction through a blacket 15 and a pin 17 and the lower side of the core is placed on a saddle 35 disposed on an upper end of a segment 20 for support rolls 19 through a bracket 16 and a pin 18. With this construction, the front face of the guide plate is brought near the cast strand containing unsolidified molten steel therein and a set of plural guide plates are supported in suspension so as to surround the cast strand 1.

Figure 1:
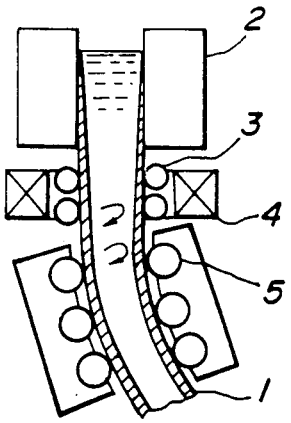
FIGS. 1 and 2 are schematic views illustrating the combination of a continuous caster and an electromagnetic stirring apparatus.
Figure 2:
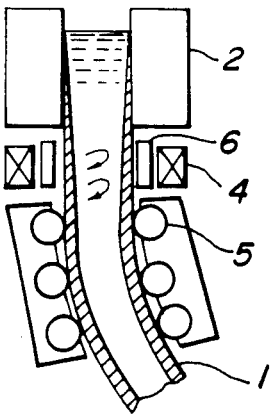
Figure 3:
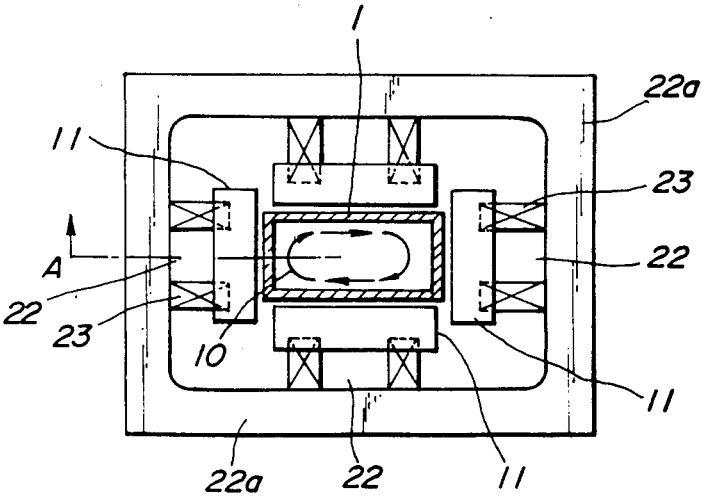
FIG. 3 is a plan view of an embodiment of the apparatus according to the invention.
Figure 9:
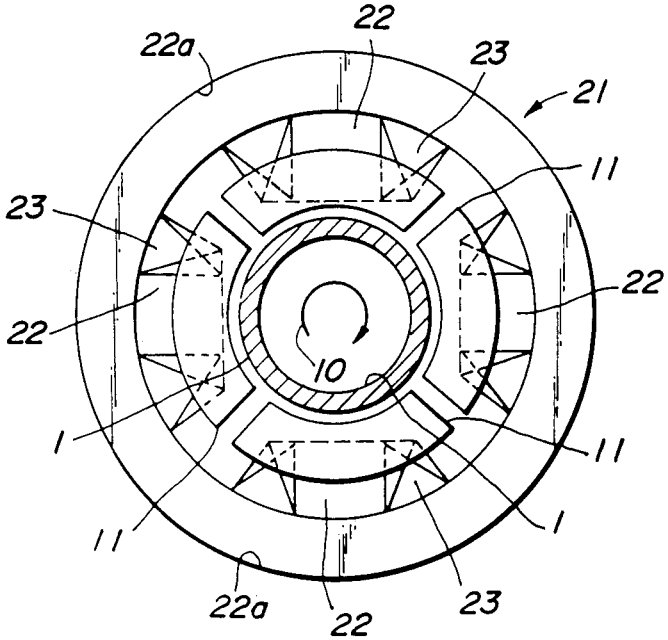
FIG. 9 is a plan view of a specific example of the invention for casting a round billet.

An electromagnetic coil 21 is arranged behind each of the guide plates 11. That is, the coil 21 is composed of the iron core 22 and a winding 23. As shown in FIGS. 3 and 9, when the outer end portions of the cores 22 are connected to a common member **22*a*** of a ring shape, the support structure becomes more simplified, but they may be independently supported in suspension.

Each coil 21 is integrally fitted to the back face of the respective guide plate 11 by screwing bolts **24*a* and 24*b* from the common member 22*a* to the guide plate 11. Between the front end face of the core 22 and the back face of the guide plate is interposed a shim 26 through bolts 25. This shim 26 is utilized to adjust the gap between the guide plate 11 and the cast strand 1, for example, when the guide plage 11 is worn. In the illustrated embodiment, there is shown the shim 26 fitted to the front face of the core 22, but to the contrary it may be fitted to the guide plate 11**.

Figure 6:
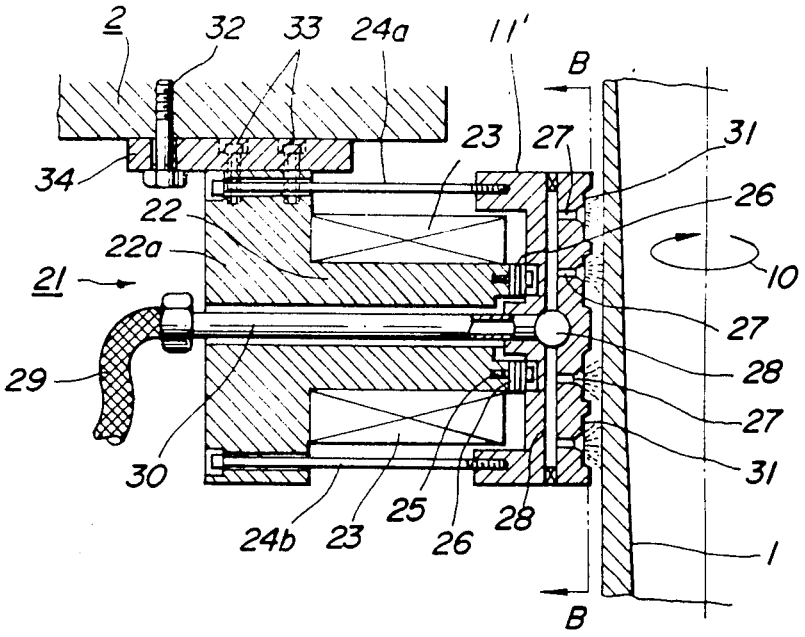
FIG. 6 is a partially sectional side view as viewed from an arrow A direction of FIG. 3.
Figure 7:
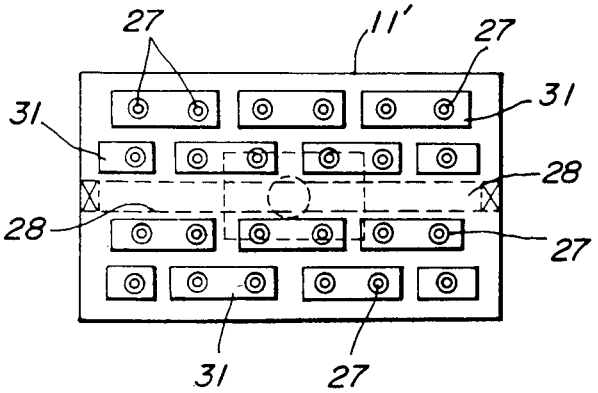
FIG. 7 is a front view of a guide plate as viewed from a line B-B arrow direction of FIG. 6.
Figure 8:
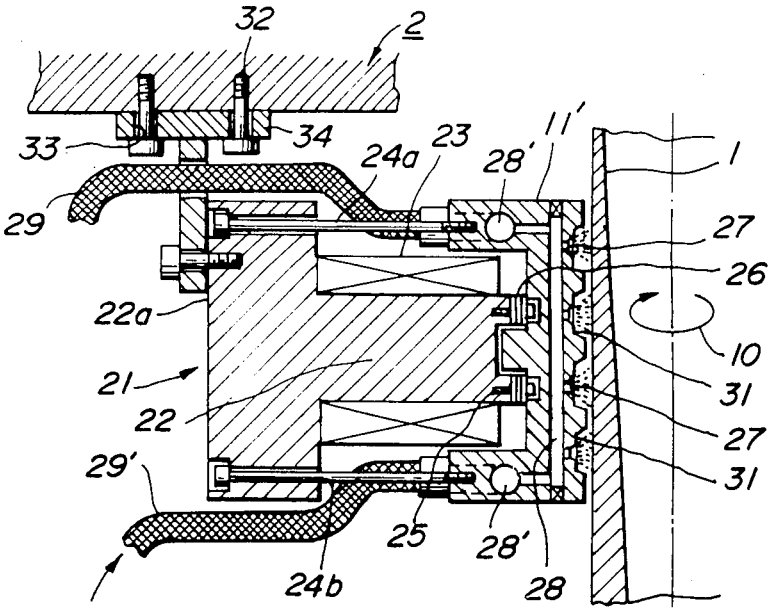
FIG. 8 is a partially sectional view of a further embodiment of the apparatus according to the invention.

In FIGS. 6–8, is shown another embodiment of the invention. In this embodiment, a guide plate 11' is provided with a plurality of spray holes 27 opening to the cast strand 1. Each of the spray holes 27 is communicated with a supply header 28 formed in the middle portion of the guide plate 11', so that a cooling liquid introduced from an inlet tube 29 is distributed into the spray holes 27 through the header 28 and spouted onto the surface of the cast strand 1 to cool the solidified shell of the cast strand.

When the header 28 is positioned in the middle portion of the guide plate 11' as shown in FIG. 6, a flow path 30 for the cooling liquid is arranged so as to pass through the central portion of the core 22, through which the inlet tube 29 is connected to the supply header 28 for supplying the cooling liquid into the spray holes 27. Moreover, when a recess 31 is formed around the open end of the spray hole 27 as shown in FIG. 7, it is convenient to obtain a uniform film-like flow of the cooling liquid.

In FIG. 8 is shown an embodiment of the electromagnetic stirring device in which the thickness of the guide plate 11' is made thinner to suppress the attenuation of the electromagnetic force with a large magnetic field penetration depth. For this purpose, two headers 28' are arranged in the vicinities of the upper and lower end portions of the guide plate and independently connected to the inlet tubes 29 and 29', respectively.

With the above construction, when the shim 26 interposed between the front face of the core 22 and the guide plate 11' is a thickened liner, it serves for core alignment and for adjustment when the size of the cast strand is changed.

In the embodiments of FIGS. 6–8 (discussed above the constituent features of which are omitted for their explanation is the same as in FIGS. 4 and 5), wherein the integral structure of the guide plate 11' and the coil 21 is obtained by tightening of the bolts **24*a*, and 24*b*. When the electromagnetic stirring apparatus is arranged just beneath the mold 2, it is supported in suspension at the bottom of the mold by means of securing bolts 32 and 33 through a flange 34**.

In the electromagnetic stirring apparatus according to the invention, a rotating magnetic field is produced by flowing an alternating current through the coil 21, whereby molten steel in the cast strand can be stirred, for instance, in a direction shown by an arrow 10 in FIGS. 3, 5, 6, 8 and 9.

As mentioned above, the apparatus according to the invention itself has the following merits.

(1) Since the guide means for the cast strand is integrally incorporated into the electromagnetic coil body, the apparatus can be made more compact and smaller. Furthermore since the coil can further approach the cast strand as compared with the conventional apparatus, it is possible to obtain more enhanced stirring effect and the apparatus being miniaturized with the coil being made smaller.

(2) Since the guide plate for the cast strand is equipped with a closed type or open spray type water cooling mechanism for the cast strand, it can be arranged and used at an arbitrary location from just beneath the mold to the secondary cooling zone where the cast strand is required to be cooled.

(3) Since the guide means is designed to fully offset the wear-out thereof by the adoption of the shim or the like, the apparatus according to the invention is deemed satisfactorily applicable to the actual operation.

(4) Since the apparatus is compact, it is easy to install into an existing continuous caster.

INDUSTRIAL APPLICABILITY

The aforementioned electromagnetic stirring apparatus is suitably used in a continuous caster for metals such as steel, aluminum and the like.

What is claimed is:

1. A continuous caster comprising a mold and an electromagnetic stirring apparatus, the electromagnetic stirring apparatus comprising a plurality of guide plates arranged just beneath the mold so as to surround a cast strand containing an unsolidified molten metal therein, each of said plurality of guide plates being adjacent to a respective one of the sides of said cast strand and provided with a flow path for a cooling liquid, and a plurality of electromagnetic coils each integrally united with a respective core, said core being detachably attached at its front face to a respective one of said plurality of guide plates and integrally supported by a common member of a ring-like shape.

2. The continuous caster according to claim 1, wherein a shim is detachably interposed between the front end face of the core and the back face of the guide plate by means of a bolt.

3. A continuous caster comprising a mold and an electromagnetic stirring apparatus, the electromagnetic stirring apparatus comprising a plurality of guide plates arranged just beneath the mold so as to surround a cast strand containing an unsolidified molten metal therein, each of said plurality of guide plates being adjacent to a respective one of the sides of said cast strand and provided with a plurality of spray holes opening to said cast strand, and a plurality of electromagnetic coils each integrally united with a respective core, said core being detachably attached at its front face to a respective one of said plurality of guide plates and integrally supported by a common member of a ring-like shape.

4. The continuous caster according to claim 3, wherein the spray holes are positioned on the extension of branched passages from a supply header formed in the guide plate.

5. The continuous caster according to claim 3, wherein the supply header is formed in the central portion of the guide plate.

6. The continuous caster according to claim 3, wherein the supply headers are formed in the vicinities of the upper and lower ends of the guide plate.

7. The continuous caster according to claim 3, wherein in the case of the supply header being formed in the central portion of the guide plate, a flow passage communicating with the supply header is arranged in the core.

8. The continuous caster according to claim 3, wherein a shim is detachably interposed between the front end face of the core and the back face of the corresponding guide plate by means of a bolt.

* * * * *